US006733337B2

(12) United States Patent
Kodaira

(10) Patent No.: US 6,733,337 B2
(45) Date of Patent: May 11, 2004

(54) COAXIAL CONNECTOR

(75) Inventor: Makoto Kodaira, Tokyo-to (JP)

(73) Assignee: Uro Denshi Kogyo Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 10/457,542

(22) Filed: Jun. 10, 2003

(65) Prior Publication Data

US 2004/0048514 A1 Mar. 11, 2004

(51) Int. Cl.[7] ..... H01R 9/05
(52) U.S. Cl. ..... 439/578; 439/320
(58) Field of Search ..... 439/578, 320, 439/339, 583–585, 307, 322, 223, 700, 824

(56) References Cited

U.S. PATENT DOCUMENTS 2,981,920 A * 4/1961 Jackson ..... 439/322
3,953,097 A * 4/1976 Graham ..... 439/307
4,892,491 A * 1/1990 Budano et al. ..... 439/700
5,393,246 A * 2/1995 Du ..... 439/578
6,344,736 B1 * 2/2002 Kerrigan et al. ..... 439/578
6,619,876 B2 * 9/2003 Vaitkus et al. ..... 439/578

* cited by examiner

*Primary Examiner*—Renee Luebke
*Assistant Examiner*—Felix O. Figueroa
(74) *Attorney, Agent, or Firm*—Jacobson Holman PLLC

(57) ABSTRACT

A coaxial connector having a tube-like shell attached to an end of a coaxial connector so as to rotate freely around the coaxial connector; the inner peripheral face of the shell has a flat face perpendicular to the axial direction, and a tapered face that continues form the flat face; at least two protrusions are provided in the tapered face, and projecting inwards from the diameter while extending in the axial direction; at least two substantially arc-like movable clips having screw grooves on their inner peripheral faces; the movable clips are arranged inside the shell so that each movable clip directly contacts the flat face in the shell, and are between the protrusions; an expanding spring is attached to the coaxial cable side end of the shell, and applies an active force so as to press the movable clips toward the flat face.

3 Claims, 4 Drawing Sheets

COAXIAL CONNECTOR

BACKGROUND OF THE INVENTION

1. Field of the Invention

This invention relates to a coaxial connector, and more particularly relates to the coaxial connector which can be easily installed.

2. Description of Related Art

In a coaxial line used in, for instance, cable television facilities and the like, a coaxial cable is connected by using a coaxial connector. The most conventional type of coaxial connector is termed a high-frequency C15 connector, and comprises a plug which screws into a receptacle.

Screw-system coaxial connectors of this type are connected by turning a nut provided on the connector many times, an operation which must be repeated for each connector, resulting in poor workability. A huge amount of time is needed to connect a great number of connectors, and, when the connectors are installed in a narrow space, such as in the case of a series unit, the burden on the person performing the operation is considerable.

SUMMARY OF THE INVENTION

The present invention has been realized after considering the problems described above, and aims to provide a coaxial connector which can be installed easily.

In order to achieve the above objects, the coaxial connector of this invention comprises a tube-like shell, which is attached to an end of a coaxial connector so as to rotate freely around the center of the core of the coaxial connector. The shell has an opening for inserting a coaxial female connector at an opposite end to the coaxial connector side. The inner peripheral face of the shell has a flat face, which is perpendicular to the axial direction, and a tapered face, which continues from the flat face. The diameter of the tapered face is narrow near the opening, and becomes larger toward the coaxial connector side end. Further, at least two protrusions are provided in part of the tapered face, and project inwards from the diameter while extending in the axial direction. At least two substantially arc-like movable clips have screw grooves on their inner peripheral faces, the screw grooves meshing with screw threads of the coaxial female connector. The movable clips are arranged inside the shell so that one end face of each movable clip directly contacts the flat face in the shell, and the outer peripheral faces of the movable clips directly contact the inner peripheral face of the shell between the protrusions. An expanding spring is attached to the coaxial cable side end of the shell, and applies an active force so as to press the movable clips toward the flat face provided on the inner peripheral face of the shell.

DESCRIPTION OF THE PREFERRED EMBODIMENTS

Figure 1:
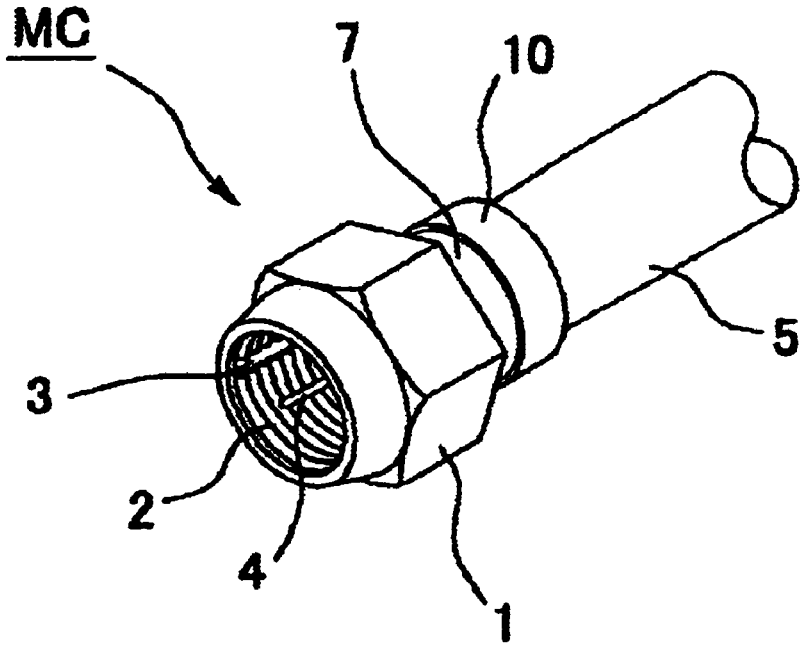
FIG. 1 is a diagram illustrating the external appearance of an embodiment of this invention.

FIG. 1 illustrates the external appearance of an embodiment of this invention. As shown in FIG. 1, two movable clips 2 are attached to the inner face of a shell 1, which constitutes the outside conductor of a coaxial male connector MC, with a protruding piece 3, provided on the inner face of the shell 1, between them. A central conductor 4 of the coaxial connector comprises the extracted core of a coaxial cable 5, and is provided in the center of the shell 1.

A calking ring 10 and a shell-supporting metal fitting 7 are attached to a connector attachment metal fitting (explained below) at the end of the coaxial cable 5, and connect to the shell 1.

The operator connects the coaxial connector to an unillustrated coaxial female connector FC by holding the shell 1, inserting it a certain way into the coaxial female connector, and rotating the shell 1 by approximately one rotation so that the movable clips 2 clip firmly into the screw threads of the coaxial female connector. That is, the connection of the coaxial connector is completed by the two actions of pushing and rotating.

To remove the coaxial connector, the operator rotates the shell 1 in the opposite direction, thereby unclipping the screw threads of the coaxial female connector from the screw grooves of the movable clips 2, and then continues to rotate the shell 1 as he removes it from the coaxial female connector FC.

Figure 2A:
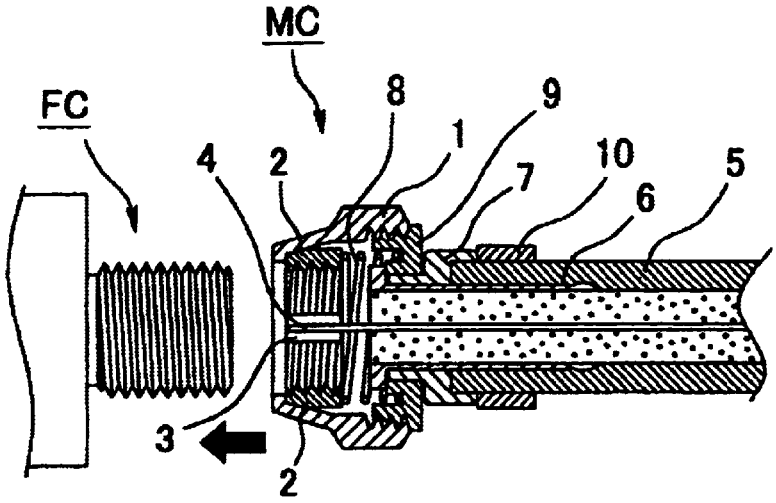
FIGS. 2(*a*) to 2(*c*) are cross-sectional views of the embodiment shown in FIG. 1, and respectively show the states immediately prior to installation to a coaxial female connector, during installation, and after completing installation.
Figure 2B:
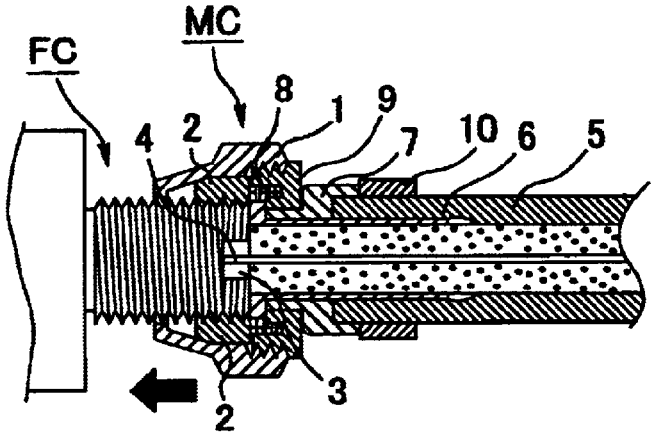
Figure 2C:
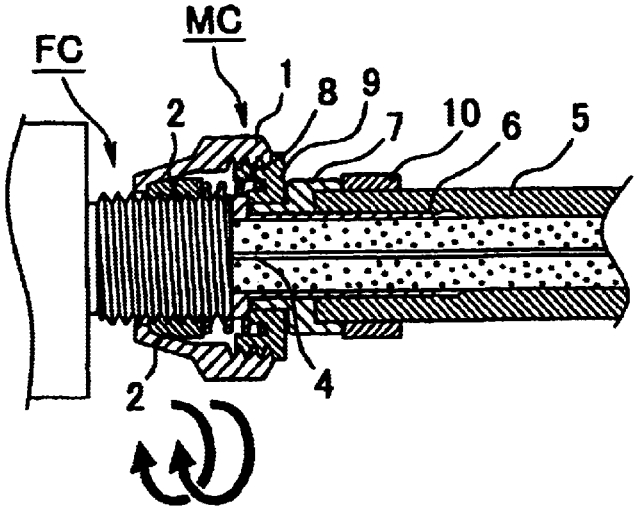

FIGS. 2 (*a*), 2(*b*), and 2(*c*) respectively show the states of the embodiment of FIG. 1 immediately prior to installation to the coaxial female connector, during installation, and after completion of the installation.

In the uninstalled state shown in FIG. 2 (*a*), the movable clips 2 inside the shell 1 are pushed toward the right of the diagram by the expansive force of a coil spring 8, and their outer faces directly contact the inner face of the shell 1.

The inner face of the shell 1 has at its open end a flat face, which is perpendicular to the axial direction, and a tapered inner peripheral face, which continues from the flat face. Consequently, the outer faces and unillustrated left-side end faces of the movable clips 2 directly contact the open-end flat face and tapered inner peripheral face of the shell 1.

The structure for attaching the shell 1 to the coaxial cable 5 will be explained. An attachment metal fitting 6 has a flange at one end, and is cylindrical, its end thickness being narrow and gradually becoming wider, so that its counter-flange side be easily inserted between the dielectric layer and the outer conductor of the coaxial cable; the attachment metal fitting 6 is inserted into the end of the coaxial cable 5 together with an assembly metal fitting 7 and the shell supporting metal fitting 9, and the calking ring 10 tightens the attachment metal fitting 6 securely in place from above the outer skin of the coaxial cable 5.

Then, the coil spring 8 is abutted into ring-like grooves facing the axial direction, provided in the shell supporting metal fitting 9, the movable clips 2 are inserted inside, and the shell 1 is pressed toward the right of the diagram so that the movable clips 2 push against the coil spring 8; the screw grooves along the inner peripheral face of the shell 1 on the right end of the diagram mesh with the screw threads provided in the outer periphery of the shell supporting metal fitting 9, thereby securing the connection.

When manufactured at a factory, the shell 1 can be attached to the shell supporting metal fitting 9 by using a structure which is more suitable for mass production than calking or the like.

As a result, the shell 1 is attached together with the shell supporting metal fitting 9 in such a manner that it can be freely rotated around the attachment metal fitting 6 and the assembly metal fitting 7.

Then, in the state during installation of the coaxial connector shown in FIG. 2(*b*), the right end (as viewed in the diagram) of the coaxial female connector FC directly contacts the left end (as viewed in the diagram) of the movable clips 2, presses them toward the right of the diagram, thereby pushing the movable clips 2 into the shell 1. At this time, the two movable clips 2 move along the tapered face of the inner periphery of the shell 1, pushing them away from each other; the coaxial female connector FC is inserted between the movable clips 2, and several of its screw threads mesh with the screw grooves provided in the inner periphery of the movable clips 2. At this time, the movable clips 2 sequentially pass over the screw threads of the coaxial female connector FC, proceeding toward the left side of the diagram each time they pass. The coil spring 8 applies a propulsive force against the movable clips 2 toward the left side of the diagram.

When the shell 1 is rotated by approximately one rotation, the coaxial connector becomes completely attached as shown in FIG. 2(*c*). That is, when the shell 1 is rotated in the state shown in FIG. 2B, it is pressed toward the left side of the diagram by an active force generated by the expansive force of the coil spring 8, and the movable clips 2 pressing against the inner peripheral face of the shell 1 rotate together. As a result, when the movable clips 2 are rotated in the direction where the screw grooves on the inner peripheries of the movable clips 2 mesh with the screw threads of the coaxial female connector FC, the movable clips 2 proceed inside the shell 1 toward the opening until they stop between the inner peripheral wall of the shell 1 and the outer peripheral wall of the coaxial female connector FC.

Therefore, the coaxial male connector MC and the coaxial female connector FC become firmly secured and connected together.

Figure 3A:
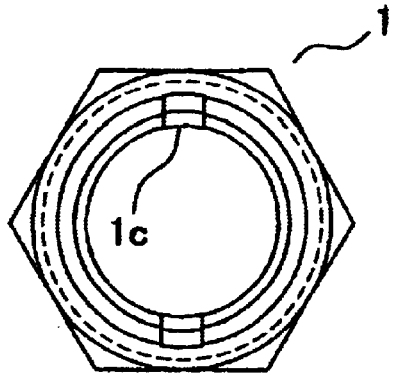
FIG. 3(*a*) is a plan view of the constitution of a shell used in the embodiment shown in FIG. 1, and FIGS. 3(*b*) and 3(*c*) are side cross-sectional views at different ninety-degree angles.
Figure 3B:
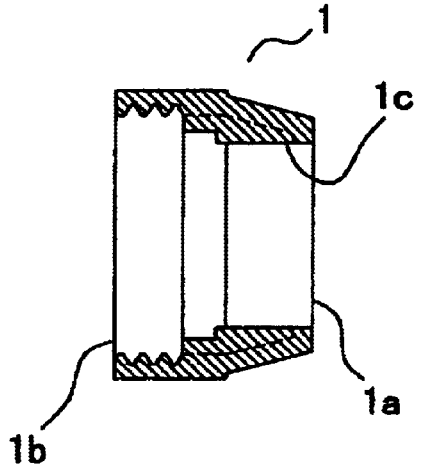
Figure 3C:
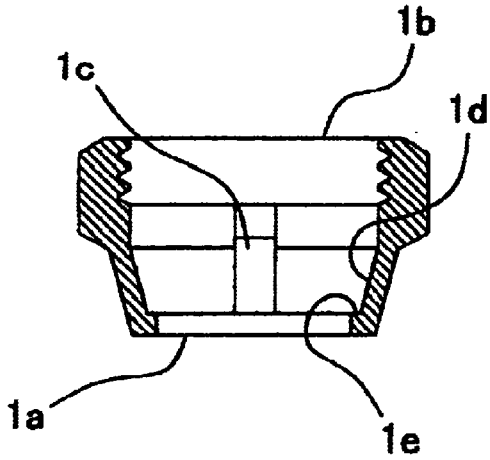

FIGS. 3(*a*) to 3(*c*) show the structure of the shell 1 in detail. One end 1*a* of the shell 1 is puckered and has an opening therein; a flat face 1*e* is provided in the inner peripheral face around the opening and is perpendicular to the axial direction. The periphery of the other end lb of the shell has the shape of a hexagonal nut.

A pair of protrusions 1*c* (corresponding to reference numeral 3 in FIG. 1) are provided in the inner periphery of the end 1*a*, and extend in the axial direction; a tapered face 1*d* is provided in the inner peripheral face where the protrusions lc are not provided. Screw grooves are provided in the inner periphery of the other end 1*b* of the shell 1.

Figure 4A:
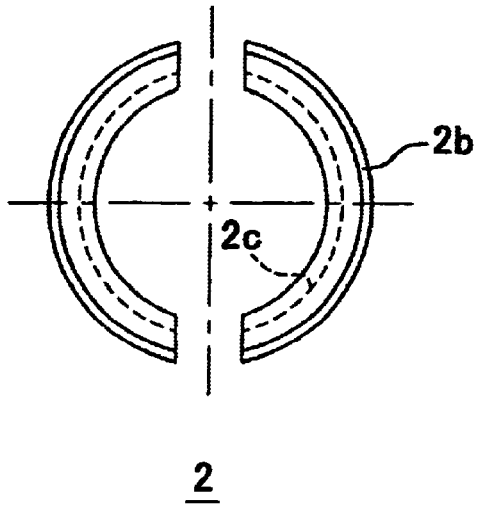
FIG. 4(*a*) is a plan view of the constitution of a movable clip used in the embodiment shown in FIG. 1, FIG. 4(*b*) is a side view of the same, and FIG. 4(*c*) is a side cross-sectional view of the same.
Figure 4B:
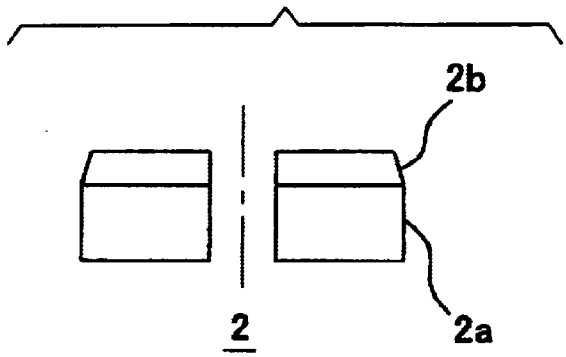
Figure 4C:
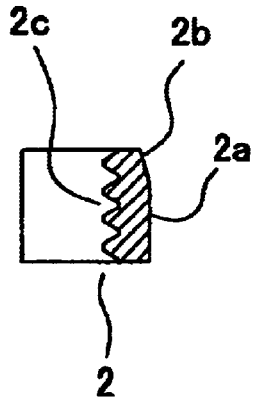

FIGS. 4(*a*) to 4(*c*) show the structure of the movable clips 2 in detail. The movable clips 2 comprise a pair of members having an arc-like shape resembling semi-circles; the outer periphery of each member is substantially cylindrical, with a taper near one end. Screw groove are provided in the inner peripheral faces of the movable clips, and mesh with the screw mountain of the coaxial female connector.

When the movable clips 2 are attached to the shell 1, as shown in FIGS. 4(*a*) and 4(*b*), the protrusion 1*c* on the inner periphery of the shell 1 becomes inserted between them.

As described above, the inner peripheral face of the shell of the coaxial male connector has a tapered shape extending toward the inside, and the screw grooves on the inner peripheral faces of the movable clips mesh with the screw mountain of the coaxial female connector. The expansive force of the spring contained in the shell presses the movable clips against the inner peripheral face of the shell. Therefore, the movable clips can be moved between the coaxial male connector and the coaxial female connector by a small rotation of the shell, securing them firmly together.

What is claimed is:

1. A coaxial connector comprising:

a tube-like shell, which is attached to an end of a coaxial connector so as to rotate freely around a center of a core of the coaxial connector, the shell having an opening for inserting a coaxial female connector at an opposite end to a coaxial connector side, an inner peripheral face of the shell having a flat face, which is perpendicular to an axial direction, and a tapered face, which continues from the flat face, the diameter of the tapered face being narrow near the opening and becomes larger toward the coaxial connector side end, at least two protrusions being provided in part of the tapered face, the protrusions projecting inwards from the diameter while extending in the axial direction;

at least two substantially arc-like movable clips having on their inner peripheral faces screw grooves, which mesh with screw threads of the coaxial female connector, the movable clips being arranged inside the shell so that one end face of each movable clip directly contacts the flat face in the shell, and outer peripheral faces of the movable clips directly contact the inner peripheral face of the shell between the protrusions; and an expanding spring, which is attached to the coaxial cable side end of the shell and applies an active force so as to press the movable clips toward the flat face provided on the inner peripheral face of the shell.

2. The coaxial connector as described in claim 1, comprising a face which is approximately perpendicular to the axial direction and stops the axial direction active force of the movable clips when the movable clips directly contact the inside of the shell near its opening.

3. The coaxial connector as described in claim 1, wherein the outer peripheral faces of the movable clips comprise cylindrical and tapered sections.

* * * * *